US006033286A

United States Patent [19]

Langlinais

[11] Patent Number: 6,033,286

[45] **Date of Patent: *Mar. 7, 2000**

[54] TOY CONVEYOR OVEN

[76] Inventor: Glenn D. Langlinais, 202 Live Oak St., Lafayette, La. 70503

[ * ] Notice: This patent issued on a continued prosecution application filed under 37 CFR 1.53(d), and is subject to the twenty year patent term provisions of 35 U.S.C. 154(a)(2).

[21] Appl. No.: 08/608,533

[22] Filed: Feb. 28, 1996

[51] Int. Cl.[7] ..... A63H 33/30

[52] U.S. Cl. ..... 446/481

[58] Field of Search ..... 446/481, 479; 99/443 C, 443 R

[56] References Cited

U.S. PATENT DOCUMENTS

| | | | |
|---|---|---|---|
| 505,175 | 9/1893 | Pfleiderer et al. | 99/443 R |
| 717,858 | 1/1903 | Igelmann | 99/443 R |
| 798,004 | 8/1905 | Baker | 99/443 R |
| 1,535,564 | 9/1925 | Billmeyer . | |
| 1,603,664 | 10/1926 | Coventry . | |
| 3,808,730 | 5/1974 | Cooper et al. . | |
| 4,467,553 | 8/1984 | Kanda | 446/481 |
| 4,515,359 | 5/1985 | Mariol | 446/481 |
| 4,571,205 | 2/1986 | Zaruba et al. | 446/491 |
| 4,739,154 | 4/1988 | Bharara et al. | 99/443 C |
| 4,772,243 | 9/1988 | Zeiss | 446/481 |
| 4,964,392 | 10/1990 | Bruno et al. | 99/443 C |
| 5,033,366 | 7/1991 | Sullivan | 99/443 C |
| 5,112,630 | 5/1992 | Scott | 99/443 C |
| 5,180,898 | 1/1993 | Alden et al. | 99/443 C |
| 5,454,471 | 10/1995 | Norvell | 206/545 |

*Primary Examiner*—Robert A. Hafer
*Assistant Examiner*—Jeffrey D. Carlson
*Attorney, Agent, or Firm*—Pillsbury Madison & Sutro, LLP

[57] ABSTRACT

A miniature toy cooking oven having a conveyor belt for movement of a simulated food product through the oven mimicing the cooking process. The toy oven is provided with a oven cavity and a storage cavity and hinged doors in a side wall to provide access to the cavities. The toy conveyor oven is useful for pretend cooking and delivering of pizzas as well as other foods and the playset includes the oven, miniature play pizzas, miniature pizza delivery pouch and a delivery pizza cap.

6 Claims, 5 Drawing Sheets

TOY CONVEYOR OVEN

BACKGROUND OF THE INVENTION

1. Field of the Invention

This invention relates generally to playsets for children and more particularly to a toy conveyor oven with which a child may simulate the activity of cooking and delivering pizza or other food products.

2. Background Information

Toys which are adapted to simulate the activities of adults are generally more pleasing to children than other types of toys and games. This is particularly true with respect to conventional kitchen appliances which might be used by the child's parents in normal day to day living. Accordingly, many types of toy appliances have been previously proposed which will carry out or simulate functions actually performed in the kitchen.

However, "eating out" by families or having "food delivered" to the home has increased in popularity in recent years. Each eating facility and business has some unique food products that strikes the fancy of its patrons and causes them to return over and over again. There have been many surveys taken through the years in an attempt to determine the most popular food the public is purchasing. Pizza has established itself in our culture as practically a staff of life. This popularity has skyrocketed with the introduction of pizza delivery. Consequently, children of contemporary families are exposed to "the eating out" establishment about the same amount as "eating at home".

Children's toys always reflect current trends. In the past, the most popular toys have been miniatures of the home kitchen. The present toy is directed to the current "eating out" trend that children will enjoy playing with because it too is an object of their contemporary environment. Children will have an enjoyable time playing restaurant just as much as they have enjoyed playing cooking in their home.

SUMMARY OF THE INVENTION

Accordingly, an object of the invention is to provide a toy or toy playset bridging the restaurant and the home environment in innocent play.

Another object is to provide a toy oven and playset which provides children playing with the toy an opportunity to be a delivery person.

The foregoing and other objects of the present invention are accomplished by a playset that includes a toy conveyor oven, miniature play pizzas or other food products, miniature delivery pizza pouch, and a delivery cap. The toy oven is provided with a conveyor belt to move a pizza or other food products into and through the oven. The oven is provided with a side opening and hinged door above the conveyor belt so that the pizza or other food product moving through the oven can be observed as it vanishes into the play cooking conveyor oven and then reappears as if it has been cooked. As another feature, the oven is provided with storage space with a side opening and hinged door in a lower portion of the oven beneath the conveyor belt.

BRIEF DESCRIPTION OF THE DRAWINGS

The various advantages and features of the present invention will be readily appreciated by persons skilled in the art from the following detailed description when read in conjunction with the drawings wherein.

DETAILED DESCRIPTION OF THE INVENTION

Figure 1:
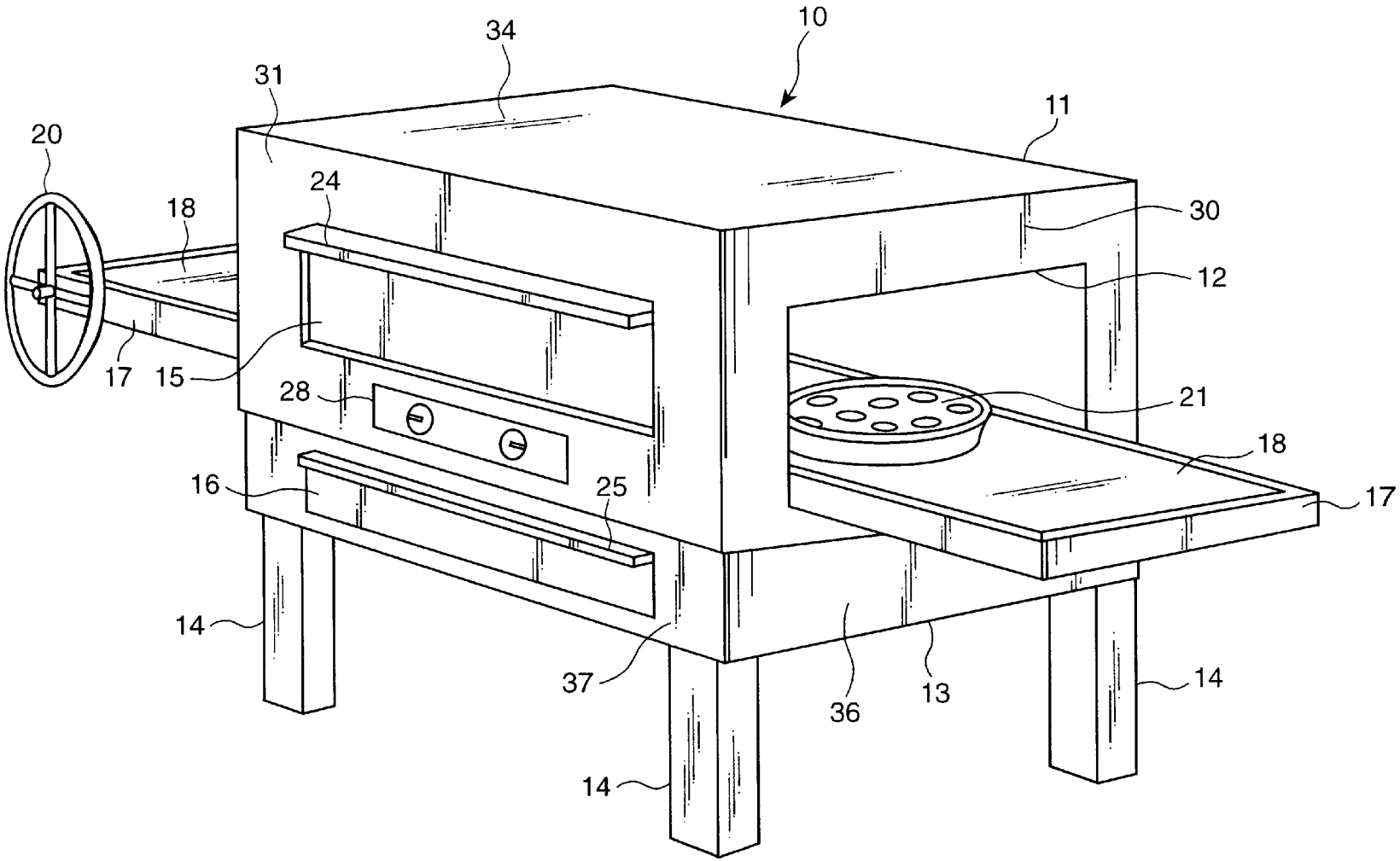
FIG. 1 is a perspective view of the external structure of the disclosed toy conveyor oven.

In the following detailed description, like elements in different figures will be referred to by like reference numerals.

FIG. 1 shows a box-shaped toy conveyor oven 10 that includes a housing 11 having an open cavity and hollow interior to which access is provided through a rectangular opening 12 and a matching rectangular opening (not shown) in the side wall 32 (see FIGS. 2 and 3) diametrically opposite to wall 30. A storage section 13 having a hollow or open interior is provided in a lower portion of oven 10. Oven 10 is also provided with legs 14, hinged doors 15 and 16, having handles 24 and 25, respectively, and a platform 17 carrying an endless conveyor belt 18 that extends through opening 12 of wall 30 and a corresponding opening in the wall 32 diametrically opposite to wall 30. A hand wheel 20 or other means is connected to a spool (not shown) which can be rotated or turned to cause the conveyor belt to move and advance through the oven. A control panel 28 having an on-off switch and a temperature gauge is provided on housing 11 below hinged door 15. A toy pizza 21 is shown on the endless conveyor belt 18.

Figure 2:
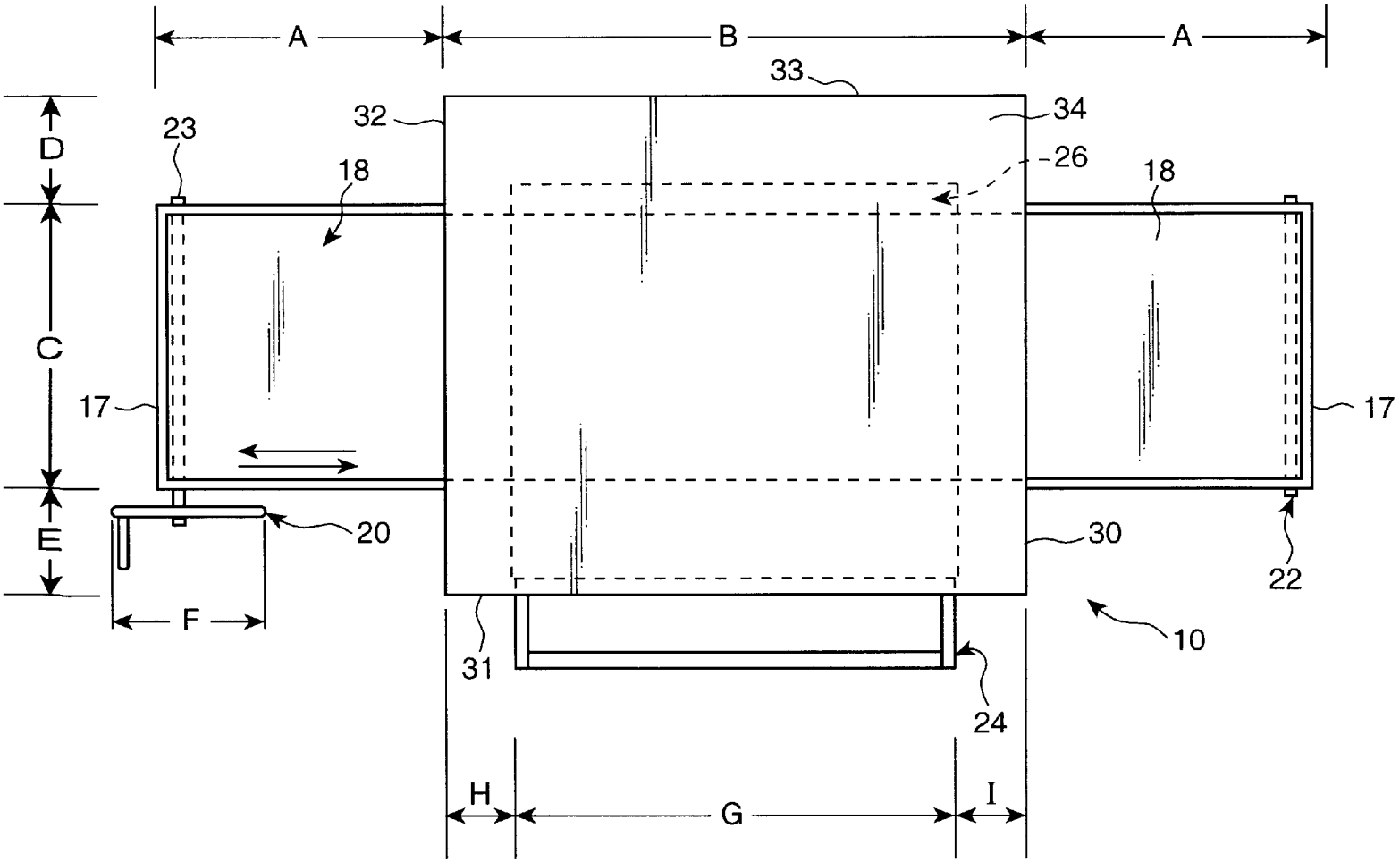
FIG. 2 is a top view of the disclosed toy conveyor oven.
Figure 3:
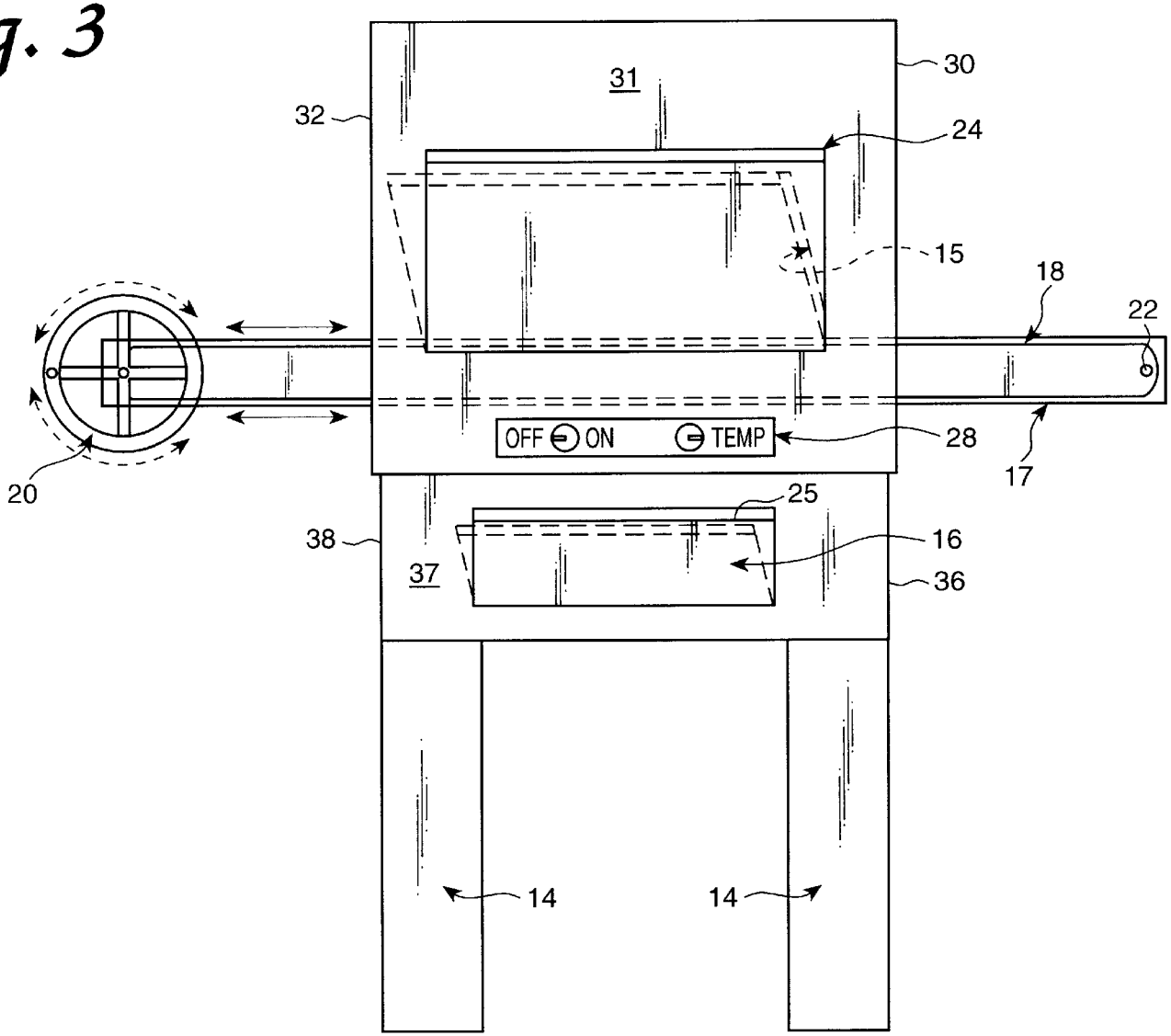
FIG. 3 is a side view of the disclosed toy conveyor oven.
Figure 4:
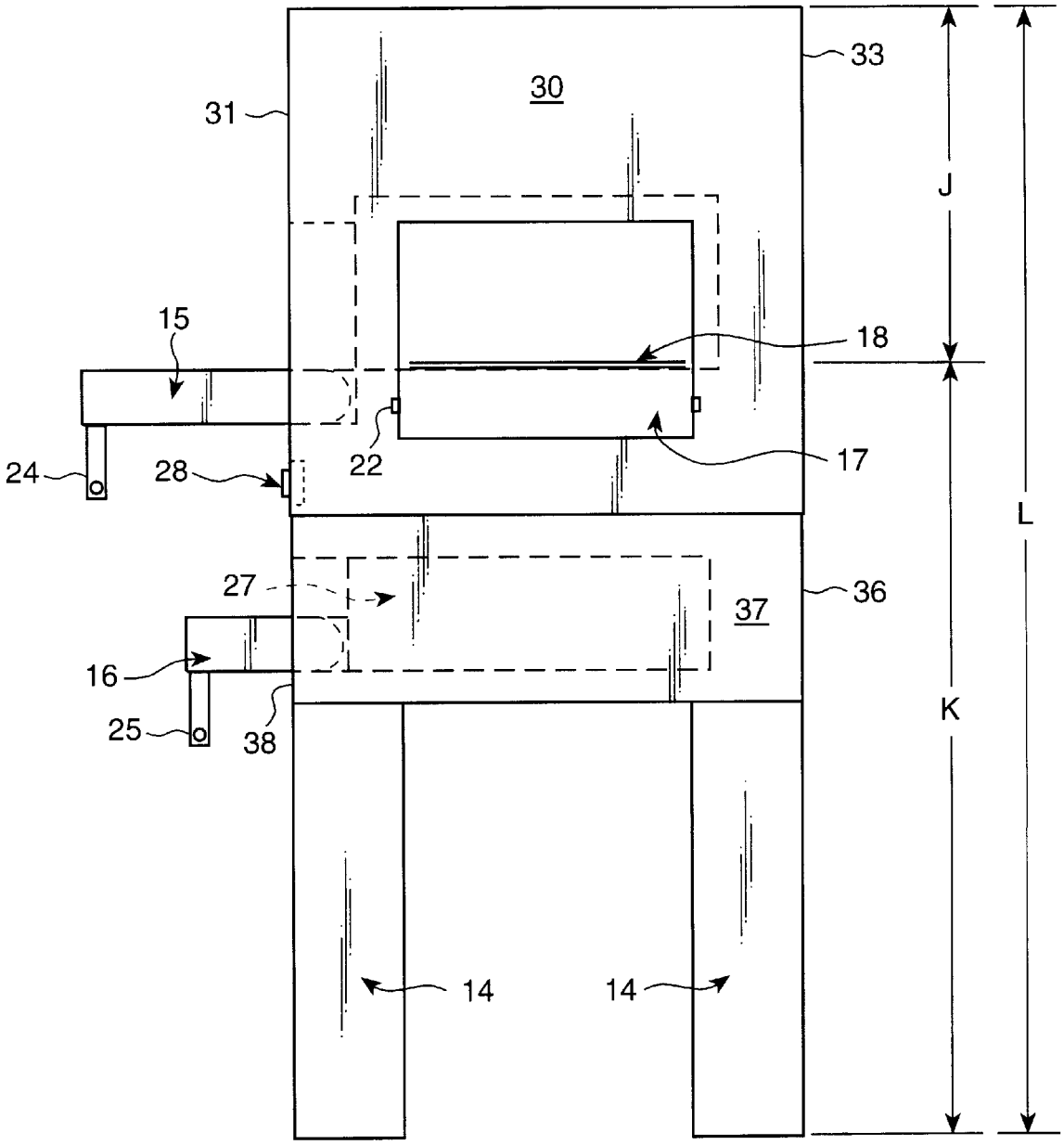
FIG. 4 is an end view of the disclosed toy conveyor oven.
Figure 5:
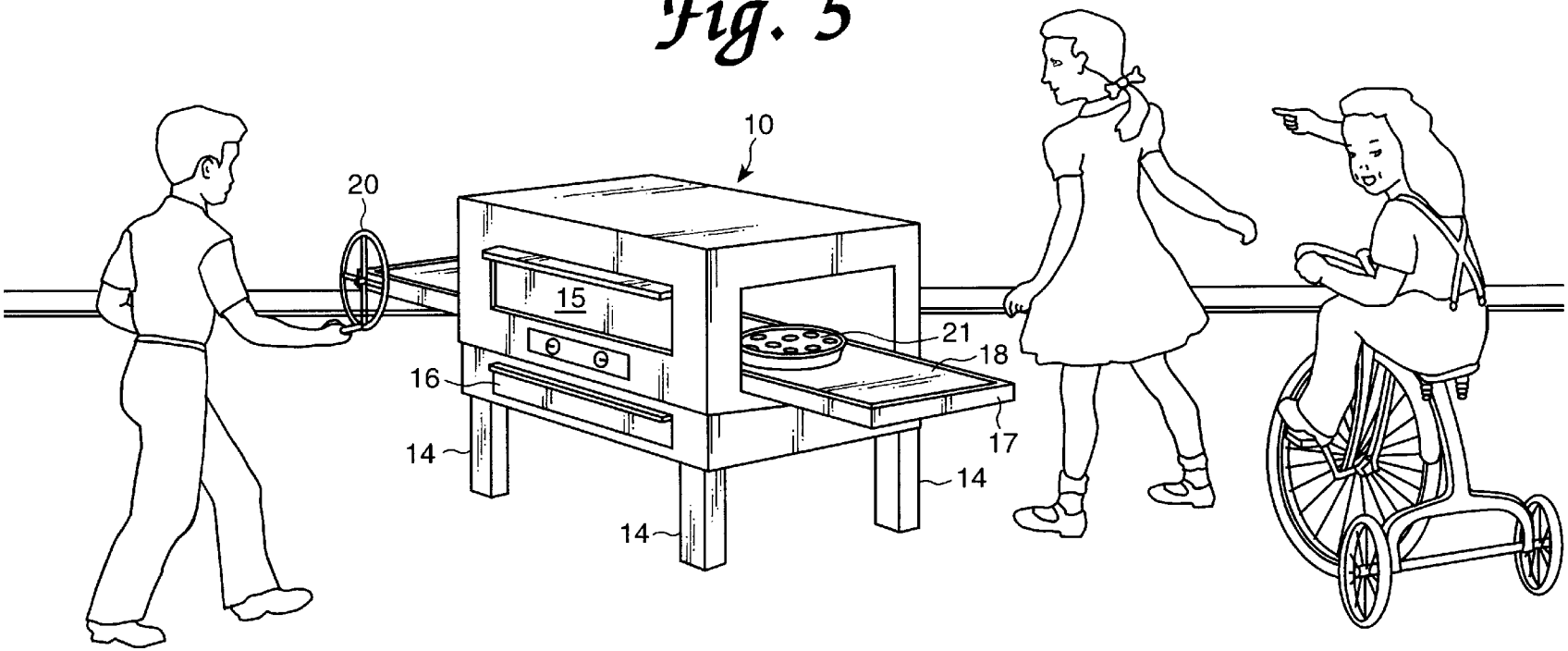
FIG. 5 is an artists perspective view of a miniature toy cooking oven.

As shown in FIGS. 1 and 2, oven housing 11 is box-shaped having an open interior and side walls 30, 31, 32 and 33 and top wall 34. Also, as shown in FIGS. 1, 3 and 4, storage section 13 is box-shaped having an open interior and side walls 36, 37, 38 and 39 and a bottom wall (not shown).

The top oven housing 11, storage section 13 and legs 14 can be made of durable but lightweight safety plastic. The endless belt conveyor can be made of pliable plastic or rubber.

Referring to FIG. 2, platform 17, which supports the endless belt 18, extends through oven 10 a substantial distance (Dimension A=about 8") beyond the sidewalls 30 and 32 to provide ready access for feeding a pizza or other food product to oven 10 and removing the pizza from the opposite end of platform 17 and belt 18 after passing through the oven cavity or oven interior 26.

Conveyor rollers or spools 22 and 23 are journalled for rotation at each end of platform 17. Roller 23 has a larger axle than roller 22 for connection with wheel 20 or other suitable means to rotate roller 23 and is secured for rotation with the roller. Conveyor belt 18 is stretched over the spaced rollers 22 and 23 so as to be in frictional engagement with the rollers. Thus, turning wheel 20 will effect linear movement of the conveyor belt.

As shown in FIG. 3, clockwise rotation of wheel 20 will move the part of the conveyor belt 18 that is atop of the platform toward the right while counterclockwise rotation will advance the upper part by the belt towards the left.

As shown in FIGS. 3 and 4, oven door 15 and holding oven/storage section door 16 are provided along the top with handles 24 and 25, respectively, and are hinged at the bottom of each door. Doors 15 and 16 open outwardly from the oven and downwardly and in the fully opened position rest on a recessed portion of oven walls 31 and 37, respectively. Housing 11 is provided with an oven interior space 26 and storage section 13 is provided with a holding oven storage area 27.

The oven interior 26 and rectangular openings 12 in side walls 30 and 32 are sufficiently large to permit installation of platform 17 and belt 18 and allow items on the belt to be moved readily through the oven. Sufficient space is allowed in wall 31 above the belt and platform mechanism for installation of door 15 so that the interior of the oven can be observed through the door.

Likewise, space 27 in storage section 13 is sufficiently large to store several miniature pizzas or other toy foods, and other equipment and is accessible by opening hinged door 16 in side wall 37.

In addition, the present toy conveyor pizza oven includes two miniature play pizzas 21, one miniature pizza delivery pizza pouch and one delivery pizza cap (not shown). These items can be stored in storage area 27.

As shown in FIGS. 2 and 4, the dimensions for the various parts of the toy conveyor oven are shown for purposes of illustration as dimensions A–L. The dimensions and approximate length for each is as follows:

| Dimension | Approximate Length |
|---|---|
| A | 8 inches |
| B | 16 inches |
| C | 8 inches |
| D | 3 inches |
| E | 5 inches |
| F | 5 inches |
| G | 12 inches |
| H | 2 inches |
| I | 2 inches |
| J | 10 inches |
| K | 21 inches |
| L | 31 inches |

The above dimensions are given as typical examples but can be smaller or larger as desired depending upon the size of oven considered most desirable and convenient.

Accordingly, it is seen that a relatively simple toy conveyor oven is provided which permits a child to pretend baking a pizza and an opportunity to mimic a pizza delivery person, but without the use of heat, batteries or electricity. Also, the toy is relatively inexpensive and simple to manufacture, and safe to play with.

Although the foregoing has been a description of certain embodiments of the present invention, changes and modifications thereto can be readily made by persons skilled in the art without departing from the scope of the present invention as defined by the following claims.

What is claimed is:

1. A toy conveyor oven for pretend cooking of a toy pizza or other toy foods comprising:

a box-shaped housing member consisting of a hollow interior, end walls, side walls, a bottom wall and a top wall enclosing the hollow interior of the oven housing and wherein the end walls are provided with matching rectangular wall openings of about the same size in the housing member to form a simulated oven;

legs connected to lower corners of the simulated oven to provide support for the simulated oven;

an inner supporting member comprising a horizontally positioned platform member extending through the simulated oven and beyond both rectangular openings;

spools suitably journalled adjacent the opposite ends of the platform;

conveyor means mounted within the simulated oven for moving pizza or other food through the oven comprising a plastic endless belt carried by the spools and positioned whereby its upper loop is passed above and its lower loop is passed beneath the platform;

a simulated non-edible toy food product; and hand-operated means manipulated from outside the simulated oven for rotating one of the spools such that movement of said spool will effect transverse movement of the conveyor belt to move the simulated toy food product through the oven, said oven being free of heating means, batteries or electricity for heating the oven to provide a toy oven safe for play.

2. A toy oven according to claim 1, further comprising an opening in a side wall parallel to and above the platform to observe movement of pizza or other food on the endless belt through the oven, the opening including a door hingedly mounted to the oven side wall.

3. A toy oven according to claim 1, further comprising an enclosed area for storage of miniature utensils in a lower portion of the simulated oven above the bottom wall and below the platform and an opening in a side wall parallel to the platform for providing access to the storage area, the opening including a door hingedly mounted to side wall.

4. The toy oven of claim 1 including:

miniature play pizzas;

miniature play delivery pizza pouch; and a delivery pizza cap.

5. A toy conveyor oven for pretend cooking of simulated pizza or other foods comprising:

a substantially enclosed rectangular box-shaped housing consisting of end walls, side walls, a bottom wall and a top wall enclosing an interior cavity and legs connected to lower corners of the housing to provide support and forming a simulated oven;

rectangular wall openings of substantially the same size and shape in opposite end walls of the housing;

an inner supporting member comprising a horizontally positioned platform member extending through the oven and a substantial distance beyond the rectangular wall openings in the opposite end walls, thereby providing an extended surface outside of the oven on opposite sides of the oven;

spools suitably journalled adjacent opposite ends of the platform;

conveyor means mounted within the oven for moving simulated pizza or other simulated foods through the oven comprising a rubber endless belt carried by the spools and positioned whereby its upper loop is passed above and its lower loop is passed beneath the platform, a simulated pizza;

hand-operated wheel means manipulated from outside the oven for rotating one of the spools such that rotation of said one spool will effect transverse movement of the conveyor belt through the oven so as to move said simulated pizza into and out of said oven;

a first opening in a side wall of the housing positioned above the platform and conveyor belt so that the user of the oven can observe progress of the movement of pizza or other food through the oven, the opening including a door hingedly mounted on the side wall for opening and closing the opening; and a second opening in a side wall positioned below the first opening to provide access to an enclosed area or cavity for storage in a lower portion of the housing and below the platform and above the bottom wall of the oven, the second opening including a door hingedly mounted to the side wall for opening and closing the second opening, said oven being free of electricity, batteries or any means for heating the oven so as to provide a toy oven safe for play.

6. The toy oven of claim 5 including:

miniature play pizzas;

miniature play delivery pizza pouch; and a delivery pizza cap.

* * * * *